US008850944B2

(12) United States Patent
Zhou

(10) Patent No.: US 8,850,944 B2
(45) Date of Patent: Oct. 7, 2014

(54) AUTOMATIC GUN SAFETY DEVICES BASED ON POSITIONING SYSTEMS

(71) Applicant: Xiaoyan Zhou, La Crescenta, CA (US)

(72) Inventor: Xiaoyan Zhou, La Crescenta, CA (US)

( * ) Notice: Subject to any disclaimer, the term of this patent is extended or adjusted under 35 U.S.C. 154(b) by 1 day.

(21) Appl. No.: 13/746,836

(22) Filed: Jan. 22, 2013

(65) Prior Publication Data

US 2014/0202058 A1 Jul. 24, 2014

(51) Int. Cl.
*F41A 19/00* (2006.01)
*F41A 17/06* (2006.01)

(52) U.S. Cl.
CPC ..... *F41A 17/063* (2013.01)
USPC ..... 89/27.12; 42/70.01; 42/70.04; 42/70.05; 42/70.08

(58) Field of Classification Search
USPC ..... 89/27.12; 42/70.01, 70.04, 70.05, 42/70.08, 70.11
See application file for complete search history.

(56) References Cited

U.S. PATENT DOCUMENTS 6,223,461 B1 * 5/2001 Mardirossian ..... 42/70.11
6,293,039 B1 9/2001 Fuchs
6,351,906 B1 3/2002 Honig, Jr. et al.
6,415,542 B1 * 7/2002 Bates et al. ..... 42/70.11
8,166,693 B2 * 5/2012 Hughes et al. ..... 42/70.08
2002/0178635 A1 * 12/2002 Martin ..... 42/70.11
2007/0271831 A1 * 11/2007 Newkirk et al. ..... 42/70.01

OTHER PUBLICATIONS

Wikipedia, "Safety (firearms)", http://en.wikipedia.org/wiki/Safety_(firearms)#Manual_safety, 8 pages, printed from the Internet on Jan. 22, 2013.
Andreas Van Hooijdonk, GPS-practice-and-fun.com, "Many Positioning Systems exist", http://www.gps-practice-and-fun.com/positioning-systems.html, 12 pages, printed from the Internet on Jan. 22, 2013.

* cited by examiner

*Primary Examiner* — J. Woodow Eldred
(74) *Attorney, Agent, or Firm* — Chen Yoshimura LLP

(57) ABSTRACT

A gun safety device on a gun automatically prevents the gun from firing when it is inside a registered area, which includes: a positioning device for determining the geographic position of a gun; a data processing device for identifying whether the gun is located within a registered area by comparing the gun's position with the stored geographic positions of the registered areas, and for generating a disable signal when the gun is identified to be inside a registered area; and a safety seizer operable to prevent the gun from discharging in response to receiving the disable signal from the data processing device. The automatic gun safety device may further include a communication device for communications with external networks. Optionally, the data processing device sends the gun's location to a monitoring center. The practice of this invention will ensure the community safety meanwhile defend the constitutional right of gun ownership.

14 Claims, 2 Drawing Sheets

AUTOMATIC GUN SAFETY DEVICES BASED ON POSITIONING SYSTEMS

BACKGROUND OF THE INVENTION

1. Field of the Invention

This invention relates to gun safety devices.

2. Description of the Related Art

From Columbine High School massacre, to Virginia Tech, to Sandy Hook Elementary School, gun safety became a serious social issue. Various gun safety devices have been described. For example, U.S. Pat. No. 6,351,906 describes "a firearm automatic locking system and method using an emitter that produces an alternating electromagnetic field to induce an eddy current in an encoder presented by an authorized user of the firearm. A sensor in the firearm detects a unique signature of the eddy current, which unique signature is based on any combination of the size, weight, composition and shape of the encoder, which is typically a ring worn by the authorized user. The eddy current signature is then compared electronically to a pre-determined value. If the signature and value are equivalent, a power circuit is closed providing an electrical current to an electrical device, thereby mechanically enabling the firing mechanism of the firearm. As long as the encoder is in adequate proximity to the automatic locking system, the weapon can be fired." (Abstract.) U.S. Pat. No. 6,293,039 describes a pistol that has "a locking mechanism that locks the trigger mechanism of the pistol if an unauthorized person attempts to fire the pistol. The locking mechanism includes an identification unit to detect an identification signal and a control unit that compares the inputted signal with a stored identification pattern. An electromechanical actuator device actuates a locking element that can be moved into a locked position and into an unlocked position, which in the locked position locks the trigger tongue of the pistol." (Abstract.)

SUMMARY OF THE INVENTION

However, the above described devices cannot prevent authorized users from shooting, killing, and massacring.

The present invention is directed to a gun safety device and related method and system that allow control and restriction of gun use automatically based on the geographic location of the gun.

An object of the present invention is to provide a gun safety device and related method and system that can effectively protect the public in certain sensitive areas such as schools, government facilities, public transportation facilities, etc.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides an automatic gun safety device installed on a gun, which includes: a positioning device receiving signals from and/or transmitting signals to external devices of a positioning system and determining a geographic position of the gun based on such signals; a data processing device coupled to the positioning device, the data processing device storing position information regarding geographic positions of a plurality of registered areas, the data processing device comparing the position of the gun determined by the positioning device with stored position information of the registered areas to determine whether the gun is located within any one of the registered areas, the data processing device generating a disable signal when the gun is determined to be located within any one of the registered areas; and a safety seizer coupled to the data processing device to receive the disable signal, operable to disable the gun to prevent it from discharging in response to receiving the disable signal.

The automatic gun safety device may further include a communication device coupled to the data processing device for communicating with an external network.

It is to be understood that both the foregoing general description and the following detailed description are exemplary and explanatory and are intended to provide further explanation of the invention as claimed.

DETAILED DESCRIPTION OF THE PREFERRED EMBODIMENTS

This invention provides an automatic gun safety device and related system and method that use GPS (Global Positioning System) and/or other positioning technologies to automatically lock or disable a gun (a firearm) to prevent it from discharging if it is located within certain pre-defined geographic areas. These pre-defined geographic areas, referred to as "registered areas" in this disclosure, are pre-registered with an administrative organization. Examples of areas that can be registered include schools, government facilities, public transportation facilities, churches, hospitals, public parks, stadiums, theaters, museums, shopping centers, business centers, etc. Government regulations or approvals may be involved in establishing what kind of areas can be registered with the administrative organization. With such gun safety devices, our kids will be safer at school, our people will be safer when wandering in shopping centers or relaxing in theaters. Meanwhile, our constitutional right of gun ownership for individual is reserved.

Figure 1:
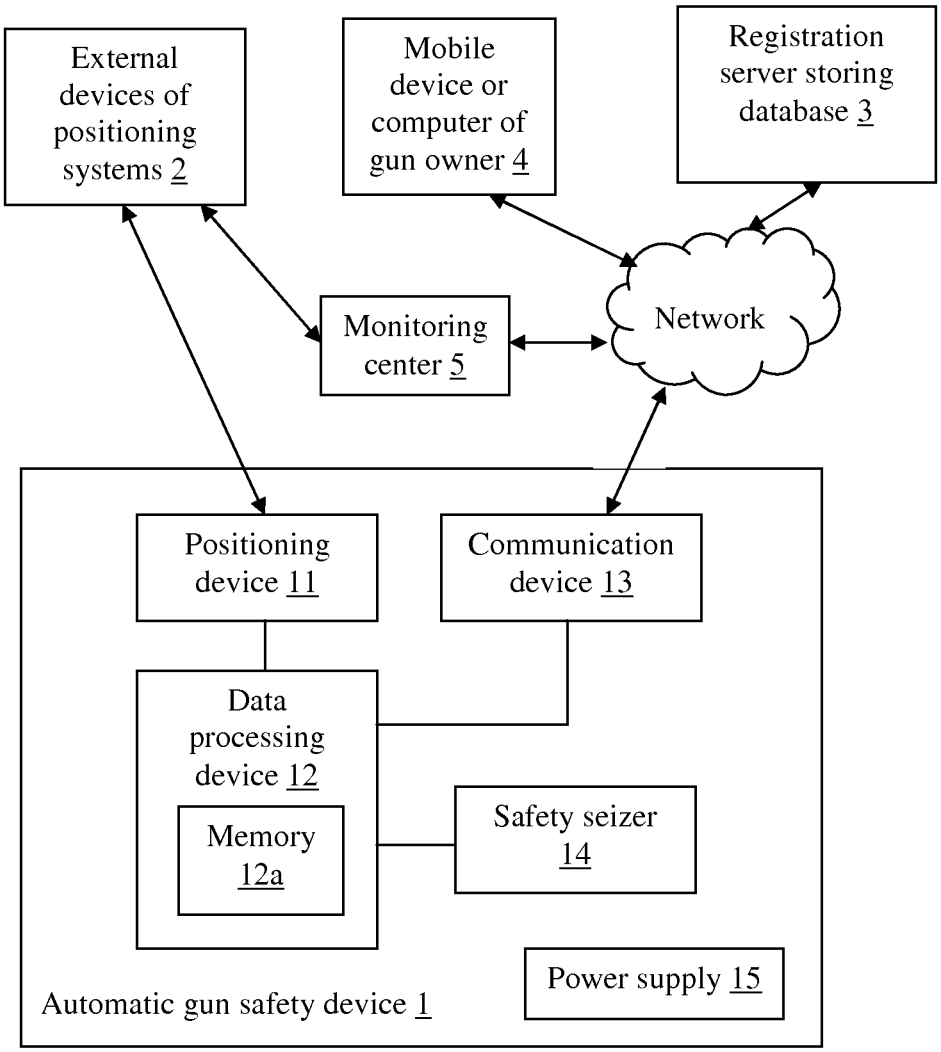
FIG. 1 schematically illustrates an automatic gun safety device installed on a gun and related external components that interact with the gun safety device according to embodiments of the present invention.
Figure 2:
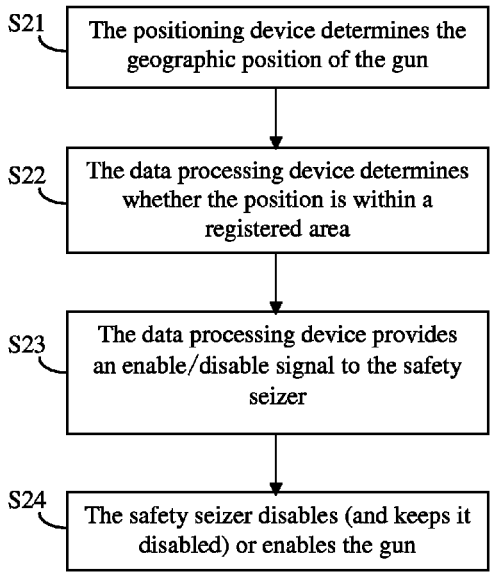
FIG. 2 schematically illustrates a control method performed by the automatic gun safety device according to an embodiment of the present invention.

FIG. 1 is a block diagram illustrating an automatic gun safety device installed on a gun and related external components that interact with the gun safety device. FIG. 2 schematically illustrates a control method performed by the automatic gun safety device.

As shown in FIG. 1, the automatic gun safety device 1, which is physically incorporated in a gun, includes a positioning device 11, a data processing device 12, a communication device 13, and a safety seizer 14. The automatic gun safety device 1 also includes a power supply 15 (e.g. a battery) for supplying power to those components.

The positioning device 11 uses one or more positioning technologies to determine the geographic position of the positioning device (and hence the geographic position of the gun) (see FIG. 2, step S21). Suitable positioning technology may include GPS (Global Positioning System), cellular technology (using radio signals between the positioning device and cellular towers of cellular networks), Wifi™ technology (using radio signals between the positioning device and Wifi points, where Wifi is a wireless local area network (WLAN) based on the IEEE (Institute of Electrical and Electronics Engineers) 802.11 standards), WiMAX technology (using radio signals between the positioning device and WiMAX-points, where WiMAX (Worldwide Interoperability for Microwave Access) is a wireless network based on the IEEE 802.16 standards), TV technology (using television (TV) signals between the positioning device and TV towers), etc. and hybrid technologies that combine two or more of the above technologies. Some specific examples include E-GPS (Enhanced-GPS), CPS (Cambridge Positioning Systems, also called Matrix positioning system), PWLS (Polaris Wireless Location Signatures), Intel PLT (Precision Location Technology), etc. Other positioning technologies may be developed in the future and can also be used in the automatic gun safety device. The positioning device 11 may use multiple positioning technologies simultaneously, or may have the ability to selectively use one or more of multiple positioning technologies depending on actual condition of the gun's location, such as indoor vs. outdoor, urban vs. rural, etc., to enhance the positioning reliability. These technologies enable the positioning device 11 to quickly identify the gun's location with an accuracy of a few feet regardless of whether the location is an open area or in an urban environment (the so called urban canyon) or even inside buildings. The positioning device 11 includes suitable hardware for receiving signals from and/or transmitting signals to suitable external devices 2 (e.g. GPS satellites, cellular towers, etc.) as required by the relevant positioning technology, as well as hardware and software for processing the signals to obtain a geographic position of the positioning device 11. Those skilled in the art will be able to implement the positioning device 11 using known technologies without undue experimentation.

Based on the positioning information from the positioning device 11, the data processing device 12 determines whether the gun is to be disabled (i.e. prevented from discharging). The data processing device 12 includes a memory 12*a* that stores information regarding geographic positions of predefined areas referred to as registered areas. By comparing the position of the gun determined by the positioning device 11 with information regarding the registered areas stored in the memory 12*a*, the data processing section 12 determines whether the position is within any registered area (see FIG. 2, step S22). If the data processing device 12 determines that the gun's position is within a registered area, it sends a disable signal to the safety seizer 14 to cause it to disable the gun; if the position is outside of any registered area, it sends an enable signal to the safety seizer 14 to cause it to enable the gun (see FIG. 2, step S23). If the positioning device 11 is unable to establish a position of the gun for any reason, the data processing device 12 sends a disable signal to the safety seizer 14.

In addition, the data processing device 12 monitors all components of the automatic gun safety device 1, including the power supply 15, and sends a disable signal to the safety seizer 14 upon detection of certain conditions regardless of the gun's geographic position. The conditions may include, for example, the amount of power remaining in the power supply dropping below a threshold, malfunction of a component, etc.

The automatic gun safety device 1 communicates with a registration server 3 to obtain the location information of the registered areas. The registration server 3 may be maintained by an administrative organization (e.g. a government body, a trade organization or other non-profit organization, a gun manufacturer, etc.) in collaboration with entities that desire to have their premise designated as registered areas. Examples of areas that can be registered include schools, government facilities, public transportation facilities, churches, hospitals, public parks, stadiums, theaters, museums, shopping centers, business centers, etc. The relevant entities provide maps of their premises to the administrative organization (the interaction between the two may be via online or offline means). A safety belt around the entity's premise may be provided as desired. For example, the width of the safety belt may be based on the range of a bullet fired from a gun. Based on such information, the administrative organization develops and continuously updates a database of registered areas, and stores the database on the registration server 3 that is connected to a network such as the Internet.

The administrative organization may publish information regarding the registered areas so that the public and gun owners are aware of these areas.

The data processing device 12 communicates with the registration server 3 automatically and periodically (e.g. weekly) to update the registered areas information stored in the memory 12*a*. The communication is done via the communication device 13, preferably using a wireless technology such as cellular or Wifi technology which provides access to the Internet. In certain instances, the communication device 13 and the positioning device 11 may share certain hardware, for example, when both use cellular technology. In other instances, e.g. when the positioning device 11 uses only a GPS system, the communication device 13 uses separate hardware from the positioning device. Alternatively (less preferred), the registered area information may be updated via a wired technology, such as by using a USB port of the communication device 13 to download the data from a computer. As another alternative (less preferred), the registered area information is updated by replacing or updating the memory chip 12*a* by a gun manufacture.

The data processing device 12 may be programmed so that if the registered areas information stored in the memory 12*a* has not been updated for a predetermined length of time, e.g. a week, the data processing device 12 sends a disable signal to the safety seizer 14 to disable the gun.

As an optional function, the communication device 13 allows the gun owner to communicate with the automatic gun safety device 1 using a suitable communication device 4 such as a computer or a mobile device that connected to the Internet. Such communication can facilitate various control and monitoring functions. In one example, the gun owner may remotely disable or enable the gun by sending a command to the automatic gun safety device 1 from the mobile device 4. In response, the data processing device 12 sends a disable or enable signal to the safety seizer 14. Control logic is implemented in the data processing device 12 so that the owner's remote disable or enable command is effective only when the gun is determined to be located outside of any registered areas.

In another example, the automatic gun safety device 1 periodically transmits the gun's location to the gun owner's communication device 4 via the communication device 13 and the network. This allows the gun owner to monitor the location of the gun. In yet another example, when the data processing device 12 detects a low power supply condition or a malfunction in any part of the automatic gun safety device 1, the data processing device 12 communicates a report to the mobile device 4 while disabling the gun.

The positioning device 11, the data processing device 12 and the communication device 13 may be implemented in one or more IC (Integrated Circuit) chips. Preferably, they are designed to minimize the power consumption, mass and size of the gun safety device 1.

Several techniques may be implemented to reduce power consumption of the automatic gun safety device 1. For example, the gun safety device 1 may be put in a standby mode in which the gun is disabled. Thus, the data processing device 12 sends a disable signal to the safety seizer 14 before the data processing device 12 puts the automatic gun safety device 1 into the standby mode. In the standby mode, the positioning device 11, the data processing device 12 and the communication device 13 are either inactive or perform significantly reduced levels of activities. For example, the positioning device 11 may obtain the position intermittently at long time intervals such as once every 10 minutes, and the communication device 13 communicates with the network intermittently at long time intervals such as once every 10 minutes. The data processing device 12 will not send an enable signal to the safety seizer 14 while in the standby mode. The gun safety device 1 may enter the standby mode automatically in response to inactivity, for example when the position of the gun has not changed in a certain time period (e.g. 10 minutes), or in response to a signal from a standby/wake switch externally provided on the gun. The gun safety device 1 may exit the standby mode when a position change is detected or a certain signal is received from the network, or in response to a signal from the external standby/wake switch. Once out of the standby mode, the data processing device 12 will perform necessary checks and will enable the gun if all conditions are properly satisfied (e.g., the registered areas information is up-to-date, all components are functioning properly, and the gun is not within any registered area).

The safety seizer 14 sets the gun in a disabled state or an enabled state in response to a disable signal or enable signal, respectively, received from the data processing device 12 (see FIG. 2, step S24). In the disabled state, the gun cannot be discharged regardless of the gun operator's actions.

Preferably, the design of the safety seizer 14 is such that damages or malfunctions of the safety seizer 14 will tend to cause the gun to be permanently disabled until the gun is repaired by an authorized gun shop or manufacture.

Preferably, the safety seizer 14 is designed to send a failure signal to the data processing device 12 if the safety seizer 14 and/or other related components are damaged or malfunction. In response, the data processing device 12 sends a disable signal to the safety seizer 14. The data processing device 12 may also report the failure to the gun owner's communication device 4 in a manner described earlier.

Preferably, the gun's frame, or the part of the frame that holds the safety seizer 14 and related structures, is constructed such that if the frame is taken apart, it will not be reassembled and the gun is no longer operable. Meanwhile, the safety seizer 14 sends a warning signal to the data processing device 12, which may forward it to the gun owner's communication device 4.

Figure 3:
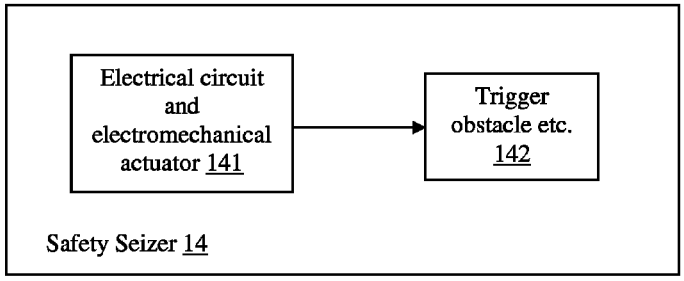
FIG. 3 schematically illustrates a safety seizer of the automatic gun safety device according to embodiments of the present invention.

In some implementations (see FIG. 3), the safety seizer 14 includes one or more electromechanical actuators 141 such as a motor, an electromagnet (solenoid), etc. which generates a mechanical movement in response to an electrical signal. For example, the electrical circuit of the safety seizer 14 may include an SCR (silicon-controlled rectifier) to provide power to a solenoid based on a control signal. The disable and enable signals may be applied to cause the same electromechanical actuator to move in two different directions, or be applied to two separate electromechanical actuators to cause their respective movements. The movements of the electromechanical actuator(s), either by themselves or via movements of intermediate mechanical parts, interfere with the trigger mechanism of the gun, causing the gun to be disabled (i.e. prevented from discharging) or enabled. Due to the diverse design of guns, the safety seizer 14 may be implemented in a variety of ways, some examples of which are described in more detail below.

Many guns already have built-in safeties (also called safety catches) to prevent the gun from accidentally discharging. A general discussion of such devices may be found in, for example, http://en.wikipedia.org/wiki/Safety_(firearms)#Manual_safety. For example, some guns have a manual switch that can be moved to a locked position that prevents the trigger from being pulled or prevent the gun from discharging when the trigger is pulled; the switch can be manually moved to an unlocked position by the user before pulling the trigger. For a gun equipped with such a manual switch, the safety seizer 14 may be implemented by providing an electromechanical actuator which, in response to the disable signal from the data processing device 12, moves the manual switch from the unlocked position to the locked position and keeps it in the locked position, or, if the manual switch is already in the locked position, keeps it in the locked position. Keeping in the switch in the locked position may be done by inserting a blocking member into a path of the manual switch to mechanically prevent the manual switch from changing from the locked to the unlocked position. In response to an enable signal from the data processing device 12, the safety seizer 14 removes the blocking member out of the path of the manual switch to allow the user to manually change the switch from the locked to the unlocked position (preferably, the safety seizer 14 does not actually move the manual switch from the locked to the unlocked position).

In another implementation (see FIG. 3), a trigger obstacle 142 is moved by one or more electromechanical actuators 141 (e.g., two electromagnets, a motor, etc.) so that it moves in or out of a path of the trigger or trigger linkage. Specifically, a disable signal from the data processing device 12 causes the electromechanical actuators 141 to move the trigger obstacle 142 into the path of the trigger or trigger linkage, so that the trigger cannot be pulled; an enable signal from the data processing device causes the electromechanical actuators to move the trigger obstacle out of the path of the trigger or trigger linkage.

To conserve power, the closure time of the electrical circuits that operate the electromechanical actuators can be as short as the time needed only to move the trigger obstacle. A pin or reed can be designed to be deployed inside a notch to hold the trigger obstacle when the magnetism from the electromagnet is ceased so that the trigger obstacle cannot move even under shocking vibrations. The pin or reed can be deployed by a spring and pulled back by the electromagnet.

The above implementation using a trigger obstacle may be used for guns that do not already have a safety. On guns that do have a safety, the trigger obstacle may be used independently of the gun's safety, or in conjunction with the safety. For example, the gun may have a manual switch as well as a trigger obstacle which is a part of the automatic gun safety device 1, when the manual switch is set to a lock position to lock the gun, the automatic gun safety device 1 may enter a standby mode to conserve power (as described above, the gun safety device 1 puts the gun in the disable state before it enters the standby mode). When the user manually changes the switch to the unlocked position, the safety device 1 wakes up from the standby mode, and will enable the gun if all conditions are properly satisfied as described above.

As a general matter, any existing designs that can lock a gun based on an electrical signal may be adapted to implement the safety seizer 14. Examples of such locking systems are described in U.S. Pat. Nos. 6,351,906 and 6,293,039. The devices disclosed in these patents can be adapted to implement the gun safety device 1 here, for example, by replacing the various components that generate the enabling electrical signal described in these patents with the devices 11, 12 and 13 shown in FIG. 1.

The automatic gun safety device 1 may be implemented as a built-in system of the gun. For guns already manufactured without the automatic gun safety device 1, they may be retrofitted by installing the automatic gun safety device 1. The specific design of the safety seizer 14 may be different for retrofitted guns.

An optional position monitoring feature may be added to the automatic gun safety device 1 to provide an enhanced version of the device. The position monitoring feature allows a monitoring center (which may be maintained by the police or other authorities) to track the position of the gun. The enhanced automatic gun safety device may be used on certain types of firearms such as semi and full automatic rifles, machine guns, etc., which are sometimes referred to as assault weapons.

As shown in FIG. 1, a monitoring center 5 is added into the system, which communicates with the external devices of the positioning system 2 and/or the communication device 13 of the automatic gun safety device 1 via the network. If the positioning technology used by the positioning device 11 is one, such as cellular or Wifi technology, that allows the external devices 2 of the positioning system to know the position of the gun, the monitoring center 5 can obtain the gun position information from the external devices 2 and does not need to obtain such information from the gun safety device 1 itself. If the positioning technology used by the positioning device 11 is a one, such as GPS, that does not allow the external devices 2 to know the position of the gun, then the monitoring center 5 will obtain the gun position information from the gun safety device 1 itself. In the latter case, the data processing device 12 of the automatic gun safety device 1 is programmed to transmit the gun position information to the monitoring center 5 via the network at sufficient frequency, at least while the gun is in the enabled state.

In use, the monitoring center 5 monitors the location of the assault weapon. The location information may be made available to the public if desired. When the gun is found to be inside a registered area, an alert may be issued, e.g. a warning signal may flash on a monitoring screen of the monitoring center 5. In addition, the monitoring center 5 may automatically send a warning or alert to a police station or other authorities near the threatened registered area. The monitoring center 5 may also send a warning or alert to the threatened registered area via the Internet or other means of communication to warn people in that area.

The monitoring center 5 may monitor other status of the gun, for example, when the gun's safety device 1 is damaged or tampered with.

To ensure reliability of the automatic gun safety device 1, the device should be made vibration resistant and shock resistant, waterproof, and capable of withstanding extreme environments such as high (above 110° F.) and cold (below −40° F.) temperatures.

The automatic gun safety device 1 should also be constructed such that it is not exposed when the gun is cleaned, and such that if it is tampered with or damaged, the gun will be disabled permanently and can no longer be operated.

It will be apparent to those skilled in the art that various modification and variations can be made in the automatic gun safety device and related method and system of the present invention without departing from the spirit or scope of the invention. Thus, it is intended that the present invention cover modifications and variations that come within the scope of the appended claims and their equivalents.

What is claimed is:

1. An automatic gun safety device installed on a gun, comprising:

a positioning device for receiving signals from external devices of a plurality of positioning systems and determining a geographic position of the gun based on such signals, wherein the positioning device is capable of determining the geographic position of the gun using any one of a plurality of different positioning technologies and automatically selects one of the plurality of different positioning technologies based on external conditions;

a data processing device coupled to the positioning device, the data processing device storing position information regarding geographic positions of a plurality of registered areas, the data processing device comparing the position of the gun determined by the positioning device with stored position information of the registered areas to determine whether the gun is located within any one of the registered areas, the data processing device generating a disable signal when the gun is determined to be located within any one of the registered areas; and a safety seizer coupled to the data processing device to receive the disable signal, operable to disable the gun to prevent it from discharging in response to receiving the disable signal.

2. The automatic gun safety device of claim 1, further comprising a communication device coupled to the data processing device for communicating with an external network.

3. An automatic gun safety device installed on a gun, comprising:

a positioning device for receiving signals from external devices of a positioning system and determining a geographic position of the gun based on such signals;

a data processing device coupled to the positioning device, the data processing device storing position information regarding geographic positions of a plurality of registered areas, the data processing device comparing the position of the gun determined by the positioning device with stored position information of the registered areas to determine whether the gun is located within any one of the registered areas, the data processing device generating a disable signal when the gun is determined to be located within any one of the registered areas;

a safety seizer coupled to the data processing device to receive the disable signal, operable to disable the gun to prevent it from discharging in response to receiving the disable signal; and a communication device coupled to the data processing device for communicating with an external network;

wherein the data processing device communicates automatically and periodically with an external registration server via the communication device to update the stored position information regarding the plurality of registered areas, and wherein the data processing device generates a disable signal if it has been unable to update the stored position information for a predetermined length of time.

4. The automatic gun safety device of claim 3, wherein the data processing device communicates with an external communication device via the communication device to receive a disable or an enable command from the external communication device and to report the geographic location of the gun to the external communication device, wherein the data processing device generates the disable or an enable signal in response to receiving the disable or enable command, respectively, only when the data processing device determines that the gun is located outside of any of the plurality of registered areas.

5. The automatic gun safety device of claim 3, wherein the data processing device transmits information regarding the geographic position of the gun to a monitoring center via the communication device.

6. An automatic gun safety device installed on a gun, comprising:

a positioning device for receiving signals from external devices of a positioning system and determining a geographic position of the gun based on such signals;

a data processing device coupled to the positioning device, the data processing device storing position information regarding geographic positions of a plurality of registered areas, the data processing device comparing the position of the gun determined by the positioning device with stored position information of the registered areas to determine whether the gun is located within any one of the registered areas, the data processing device generating a disable signal when the gun is determined to be located within any one of the registered areas;

a safety seizer coupled to the data processing device to receive the disable signal, operable to disable the gun to prevent it from discharging in response to receiving the disable signal;

a communication device coupled to the data processing device for communicating with an external network; and a power supply for supplying power to the positioning device, the data processing device, the safety seizer and the communication device;

wherein the data processing device monitors functions of the positioning device, the data processing device, the safety seizer, the communication device and the power supply to detect any damage or malfunction, wherein the data processing device generates the disable signal when any damage or malfunction is detected, and wherein the data processing device generates an enable signal when the gun is determined to be located outside of any of the plurality of registered areas and when no damage or malfunction is detected.

7. The automatic gun safety device of claim 6, wherein the safety seizer includes an electromechanical actuator which moves in response to the safety seizer receiving the disable signal or the enable signal from the data processing device.

8. The automatic gun safety device of claim 1, wherein the safety seizer includes an electromechanical actuator which moves in response to the safety seizer receiving the disable signal from the data processing device.

9. The automatic gun safety device of claim 1, wherein in response to a receiving a standby signal, the data processing device generates a disable signal, the safety seizer disables the gun in response to the disable signal, and the data processing device and the positioning device enters an inactive or low activity state.

10. The automatic gun safety device of claim 3, wherein the safety seizer includes an electromechanical actuator which moves in response to the safety seizer receiving the disable signal from the data processing device.

11. The automatic gun safety device of claim 3, wherein in response to a receiving a standby signal, the data processing device generates a disable signal, the safety seizer disables the gun in response to the disable signal, and the data processing device and the positioning device enters an inactive or low activity state.

12. The automatic gun safety device of claim 6, wherein in response to a receiving a standby signal, the data processing device generates a disable signal, the safety seizer disables the gun in response to the disable signal, and the data processing device and the positioning device enters an inactive or low activity state.

13. The automatic gun safety device of claim 8, further comprising a manual switch having a locked position that prevents the gun from discharging, wherein the electromechanical actuator moves the manual switch from an unlocked position to the locked position and keeps it in the locked position, or, if the manual switch is already in the locked position, keeps it in the locked position.

14. The automatic gun safety device of claim 13, wherein damages or malfunctions of the safety seizer cause the gun to be permanently disabled.

* * * * *